United States Patent [19]

Patrician et al.

[11] Patent Number: 4,717,538

[45] Date of Patent: Jan. 5, 1988

[54] MOLYBDENUM-TUNGSTEN-TITANIUM-ZIRCONIUM-CARBON ALLOY SYSTEM

[75] Inventors: Thomas J. Patrician, Monroeton; Gene T. Schaeffer, Towanda; Harry D. Martin, III, Troy, all of Pa.

[73] Assignee: GTE Products Corporation, Stamford, Conn.

[21] Appl. No.: 935,910

[22] Filed: Nov. 28, 1986

[51] Int. Cl.[4] ..... C22C 27/04

[52] U.S. Cl. ..... 420/429; 420/431; 420/580

[58] Field of Search ..... 420/429, 431, 580

[56] References Cited

U.S. PATENT DOCUMENTS

| | | | |
|---|---|---|---|
| 3,169,860 | 2/1965 | Semchyshen | 420/429 |
| 3,995,587 | 12/1976 | Carrara | 420/429 |
| 4,165,982 | 8/1979 | Tatsuo et al. | 420/429 |

*Primary Examiner*—L. Dewayne Rutledge
*Assistant Examiner*—Robert L. McDowell
*Attorney, Agent, or Firm*—Donald R. Castle; L. Rita Quatrini

[57] ABSTRACT

A molybdenum-tungsten-titanium-zirconium-carbon alloy system is disclosed having a composition in percent by weight of from about 0.01 to about 0.15 carbon, from about 0.06 to about 0.20 zirconium, from about 0.40 to about 0.75 titanium, from about 10 to about 60 tungsten, and the balance molybdenum.

2 Claims, No Drawings

MOLYBDENUM-TUNGSTEN-TITANIUM-ZIRCONIUM-CARBON ALLOY SYSTEM

This invention relates to a molybdenum-tungsten-titanium-zirconium-carbon alloy system.

BACKGROUND OF THE INVENTION

Currently the interest in isothermal forging dies of high strength and metal-metal matrix composite material is quite high. These applications require material that has high strength at temperatures of 1000° C. and above. Because arc cast alloys are very expensive and require more metalworking to develop mechanical properties than do powder metallurgical (P/M) alloys, P/M alloys are used exclusively for isothermal forging dies. However, for high strength fibers intended for use in composites, materials from both methods are being considered. The more expensive arc cast alloys have better chemistry control than the P/M alloys which generally tend to have higher oxygen contents that are detrimental to property development.

Of the currently available alloys that are suitable for these applications, three are listed below in the order of decreasing strength at about 1000° C.:

1. Mo+W+Hf+C —HWM
2. Mo+Hf+C —HCM
3. Mo+Ti+Zr+C —TZM or MT-104

SUMMARY OF THE INVENTION

In accordance with one aspect of this invention there is provided a molybdenum-tungsten-titanium-zirconium-carbon alloy system having a composition in percent by weight of from about 10 to about 60 tungsten, from about 0.40 to about 0.75 titanium, from about 0.06 to about 0.20 zirconium, from about 0.01 to about 0.15 carbon, and the balance molybdenum.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The alloy system of this invention is a molybdenum-tungsten-titanium-zirconium-carbon alloy system consisting essentially of in percent by weight from about 10 to about 60 tungsten, from about 0.40 to about 0.75 titanium, from about 0.06 to about 0.20 zirconium, from about 0.01 to about 0.15 carbon, and the balance molybdenum.

The preferred range of composition of the alloy is as follows in percent by weight: from about 20 to about 45 tungsten, from about 0.4 to about 0.70 titanium, from about 0.06 to about 0.12 zirconium, from about 0.05 to about 0.12 carbon, and the balance molybdenum. An especially preferred composition is as follows in percent by weight: about 25 tungsten, about 0.50 titanium, about 0.10 zirconium, about 0.10 carbon, and the balance molybdenum.

It is to be understood that the alloying constituents can be supplied in any acceptable form to result in their proper levels in the alloy without departing from the scope of the invention. For example, in addition to being supplied as zirconium, titanium, and carbon powders, the zirconium, titanium, and carbon constituents can be supplied in the form of zirconium carbide, titanium carbide, and titanium dihydride powders. The molybdenum and tungsten constituents can be supplied in the form of molybdenum metal powder, tungsten metal powder, or co-reduced molybdenum-tungsten powder. It would be obvious to one of ordinary skill in the art how to formulate the correct composition based on the particular form of constituents.

The alloying constituents can be blended together by any conventional method to made a uniformly distributed powder.

The resulting blend is then pressed and solid state sintered using conventional techniques. If titanium hydride is used, it breaks down during sintering to titanium, and hydrogen gas is liberated.

Upon completion of sintering, the alloying constituents are distributed through the Mo-W matrix in essentially the same manner as in a melted alloy of the same chemical composition.

After sintering, the resulting billet can be metalworked by forging to make die bodies or it can be extruded or rolled to make rods or sheet, or it can be drawn to wire.

The alloy of this invention designated as a TWM alloy, has high temperature strength properties which are comparable to hafnium containing alloys, such as HCM and HWM.

To illustrate an application of the alloy of this invention, the following non-limiting example is presented.

EXAMPLE

For the application of wire for metal-metal matrix fibers an ingot weighing about 6 kg and about 0.9" in diameter and about 36" long is sintered to at least 91% of the theoretical density. The ingot is then rolled in a conventional tandem rolling mill such as a manufactured by Friedrich Kocks and is sold under the name of Kocks Rolling Mill, at a temperature greater than about 1400° C. to about 0.5" in diameter and then fully recrystallized and rolled again to about 0.3" in diameter. The rod is then fully recrystallized and swaged to about 0.16" in diameter at temperatures above about 1100° C. Another full recrystallization anneal at about 0.16" is followed by swaging to about 0.1" at temperatures above about 1100° C. Below about 0.1" wiredrawing is carried out down to about 0.02" without additional anneals. For sizes below this a stress relief anneal (below the recrystallization temperature) is conducted. Wire drawing temperatures begin at about 850° C. and are progressively lower as the wire size decreases. For an alloy of this invention (TWM-27 designation) having a weight composition of about 27% W, about 0.4% Ti, about 0.07% Zr, about 1100 ppm C, and the balance Mo, the high temperature properties are given in Table I for rod of about 0.3" in diameter along with values for a molybdenum-hafnium-carbon alloy (HCM), a molybdenum-titanium-zirconium-carbon alloy (MT-104), and a molybdenum-tungsten-hafnium-carbon alloy (HWM-25). The data show that the TWM allow of this invention is comparable in strength to the HWM alloy at a temperature of about 1000° C. Table II shows a comparison of hot strength of the TWM alloy of this invention, HCM, and a potassium doped W wire at various sizes. From the wire strengths of Table II it can be seen that the TWM is as strong at about 26.5 mil as the HCM is at about 15 mil. It is expected that as the 26.5 mil TWM material is drawn to about 15 mil, it will be superior in strength to the HCM wire.

TABLE I

| MATERIAL | YIELD STRENGTH OF 0.273" ROD (ksi) | | |
|---|---|---|---|
| | 982° C. | 1098° C. | 1316° C. |
| HWM-25 | 113 | 108 | 104 |
| TWM-27 | 98 | 97 | 82 |
| HCM | 85 | 79 | 75 |
| MT-104 | 70 | 72 | 64 |

TABLE II

| MATERIAL | DIAMETER (mil) | ULTIMATE TENSILE STRENGTH (ksi) | | |
|---|---|---|---|---|
| | | 1000° C. | 1100° C. | 1200° C. |
| TWM | 26.5 | 180 | 166 | 155 |
| HCM | 15 | 184 | 164 | 141 |
| K DOPED W WIRE | 15.0 | 141 | 122 | 107 |

While there has been shown and described what are at present considered the preferred embodiments of the invention, it will be obvious to those skilled in the art that various changes and modifications may be made therein without departing from the scope of the invention as defined by the appended claims.

What is claimed is:

1. A molybdenum-tungsten-titanium-zirconium-carbon alloy system consisting essentially of in percent by weight from about 10 to about 60 tungsten, from about 0.40 to about 0.75 titanium, from about 0.06 to about 0.20 zirconium, from about 0.01 to about 0.15 carbon, and the balance molybdneum.

2. An alloy system of claim 1 consisting essentially of in percent by weight from about 20 to about 45 tungsten, from about 0.4 to about 0.70 titanium, from about 0.06 to about 0.12 zirconium, from about 0.05 to about 0.12 carbon, and the balance molybdenum.

* * * * *